US005219690A

United States Patent [19]

Hammond

[11] Patent Number: 5,219,690

[45] Date of Patent: Jun. 15, 1993

[54] SUBSTRATE AND PROCESS FOR COATING A SUBSTRATE WITH MULTI-PIGMENT CHARGE GENERATION LAYERS

[75] Inventor: John M. Hammond, Ontario, N.Y.

[73] Assignee: Xerox Corporation, Stamford, Conn.

[21] Appl. No.: 684,382

[22] Filed: Apr. 12, 1991

[51] Int. Cl.[5] ..... G03G 15/02; F23D 11/00

[52] U.S. Cl. ..... 430/58; 239/3; 239/224; 239/418; 239/703; 118/730

[58] Field of Search ..... 430/58; 239/3, 418, 239/224, 703; 118/730

[56] References Cited

U.S. PATENT DOCUMENTS

| | | | |
|---|---|---|---|
| 1,721,381 | 7/1929 | Ellis . | |
| 1,823,844 | 9/1931 | Riley . | |
| 2,087,627 | 7/1937 | Nyrop . | |
| 2,587,083 | 2/1952 | Andermatt . | |
| 2,975,756 | 3/1961 | Reindl et al. . | |
| 3,053,312 | 9/1962 | Villoresi . | |
| 3,121,024 | 2/1964 | Wampler et al. . | |
| 3,233,580 | 2/1966 | Levake . | |
| 3,233,581 | 2/1966 | Levake . | |
| 3,355,106 | 11/1967 | Graham . | |
| 3,452,931 | 7/1969 | Knowles . | |
| 3,844,705 | 10/1974 | Miyahara . | |
| 4,009,967 | 3/1977 | Layton . | |
| 4,162,039 | 7/1979 | Hallerback et al. . | |
| 4,270,698 | 6/1981 | Bisa et al. . | |
| 4,555,058 | 11/1985 | Weinstein et al. . | |
| 4,643,357 | 2/1987 | Culbertson et al. . | |
| 4,785,995 | 11/1988 | Yamane et al. . | |
| 5,011,086 | 4/1991 | Sonnleitner et al. | 239/691 |
| 5,037,676 | 10/1991 | Petrupoulos et al. | 118/730 |
| 5,100,057 | 3/1992 | Wacker et al. . | |

FOREIGN PATENT DOCUMENTS

| | | |
|---|---|---|
| 0109224 | 5/1984 | European Pat. Off. . |
| 990398 | 9/1951 | France . |

*Primary Examiner*—Marion E. Mc Camish
*Assistant Examiner*—Mark A. Chapman
*Attorney, Agent, or Firm*—Oliff & Berridge

[57] ABSTRACT

A process for coating a substrate such as a photoreceptor is performed by delivering at least two fluid streams to a bell of a rotary atomizer, combining the fluid streams substantially at the bell of the rotary atomizer such that the bell atomizes and mixes the fluid streams into a substantially homogenous atomized mixture, and depositing the mixture onto the substrate in the form of a layer on the substrate. The process is useful for depositing a plurality of different substances, such as two charge generating pigments, on the surface of a substrate such as a photoreceptor. Because the substances are combined substantially at the bell of the rotary atomizer and subsequently dried or polymerized, different substances can be incorporated into a single layer on the substrate that would normally not be combinable due to interaction between the plurality of substances such as agglomeration.

17 Claims, 3 Drawing Sheets

SUBSTRATE AND PROCESS FOR COATING A SUBSTRATE WITH MULTI-PIGMENT CHARGE GENERATION LAYERS

BACKGROUND OF THE INVENTION

1. Cross Reference to Related Application

This application is technically related to another application entitled "Multiple Fluid Injection Nozzle Array for Rotary Atomizer" filed Apr. 12, 1991 by John M. Hammond and John Matta, the disclosure of which is herein incorporated by reference.

2. Field of the Invention

The invention relates to a substrate such as a drum or flexible belt photoreceptor for photocopiers, and a process for coating such a substrate. More particularly, the invention relates to a process for simultaneously coating a substrate with multiple substances by separately delivering at least two fluid streams, such as two streams of charge generation dispersions, to a bell of a rotary atomizer, combining the streams substantially at the bell of the atomizer, for mixing and atomizing at the bell and subsequent depositing on a substrate.

3. Description of Related Art

A photoreceptor is a cylindrical or belt-like substrate used in a xerographic apparatus. The photoreceptor substrate is coated with one or more layers of a photoconductive material, i.e., a material whose electrical conductivity changes upon illumination. In xerographic use, an electrical potential is applied across the photoconductive layer and then exposed to light from an image. The electrical potential of the photoconductive layer decays at the portions irradiated by the light from the image, leaving a distribution of electrostatic charge corresponding to the dark areas of the projected image. The electrostatic latent image is made visible by development with a suitable powder. Better control of the coating quality yields better imaging performance.

One method of coating substrates is to dip the substrate in a bath of the coating material. This method is disadvantageous because it usually results in a non-uniform coating. In particular, when the substrate is oriented vertically and dipped into a bath, the coating thickness tends to "thin" or decrease at the top of the substrate and "slump" or increase at the base of the substrate due to gravity induced flow of the coating material as the substrate is lifted from the bath. Thickness variations also occur even when the photoreceptor is oriented horizontally and dipped into the bath due to the formation of a meniscus as the substrate is removed from the bath. This variation in coating thickness causes variations in the performance of the photoreceptor. In addition, the dipping process requires additional processing controls because the bath must be constantly maintained in a state suitable for coating. The bath increases the size of the entire processing apparatus and is not readily adaptable to rapid changes in coating formulations. Further, changes in coating formulations are inhibited due to incompatibilities between formulations for successive coatings or layers. It is also difficult to incorporate cleaning and curing operations that are compatible with the dipping process for efficient modular operation as a manufacturing process.

In another method, an air assisted automatic spray gun uses high velocity air to atomize the coating formulation which is sprayed onto a substrate. Due to high mass transfer rates intrinsic to the use of atomizing air, this method entails considerable evaporative loss of solvent from the spray droplets and requires the use of slow evaporating solvents to prevent excessive solvent loss before the droplets arrive at the substrate. It is difficult to use this method in a sealed environment, and thus difficult to control the solvent humidity surrounding the substrates prior to, during, or after the coating process. In addition, the air atomized spray method creates a considerable amount of overspray which results in higher material usage. Air spray guns also are less advantageous for batch processing of a number of substrates.

In copending U.S. application Ser. No. 07/457,958 (to John M. Hammond et al, filed Dec. 27, 1989), the subject matter herein incorporated by reference, a substrate such as a photoreceptor is coated in a process which uses a rotary atomizer having a single fluid feed tube. If it is desired to deposit a plurality of substances on a substrate, the substances can be fed consecutively to the rotary atomizer for spraying and depositing on the substrate with drying of each layer after deposition. Such a process requires time for drying each layer, as well as flushing of the single fluid feed line, if necessary. Feeding a plurality of substances, such as multiple pigments, through the single feed line would be disadvantageous because the substances would first need to be mixed prior to feeding to the atomizer. Such prior mixing would be undesirable for incompatible substances which could agglomerate where they are first mixed, in the feed line itself, or on the substrate.

OBJECTS AND SUMMARY OF THE INVENTION

It is thus an object of the invention to obviate the foregoing drawbacks by providing a more efficient process for coating substrates, such as photoreceptors.

Another object of the invention is to provide a process for depositing a layer on a substrate by delivering two fluid streams to a bell of a rotary atomizer and combining the fluid streams substantially at the bell such that the streams are atomized and mixed and subsequently deposited onto a substrate.

It is a further object of the invention to provide a process for atomizing, mixing and depositing on a substrate a plurality of fluid streams, wherein one or more of the fluid streams is a stream of a liquid dispersion of photoconductive particles.

A still further object of the invention is to provide a process for coating a substrate with at least two incompatible fluid streams in a short period of time to avoid a reaction between or agglomeration of the different fluids on the surface of the substrate.

Another object of the invention is to provide a process for simultaneously coating a substrate with different dispersions to avoid coating and drying each dispersion separately.

Another object of the present invention is to provide a substrate with a mixture of more than one photoconductive pigment in a single layer.

Another object of the present invention is to provide a photoreceptor with superior imaging performance.

A further object of the present invention is to provide a photoreceptor having two or more photoconductive pigments in a single layer, such that the photoreceptor has a high degree of sensitivity across a broad range of wavelengths of light.

A still further object of the present invention is to provide a photoreceptor sensitive to visible light and usable in a light lens copier, as well as sensitive to infrared light and usable in a laser printer.

These and other objects and advantages are obtained by a substrate and process for coating a substrate in accordance with the invention.

The inventive process and substrate formed by the process, includes separately delivering at least two substances in at least two fluid streams to a bell of a rotary atomizer, combining the fluid streams substantially at the bell of the rotary atomizer such that the bell atomizes and mixes the fluid streams into a substantially homogenous atomized mixture, and depositing the substantially homogenous atomized mixture onto a substrate in the form of a layer. Preferably, at least one of the plurality of fluid streams is a stream of a liquid dispersion of photoconductive particles, and the layer on the substrate is solidified by evaporation of a solvent within the fluid streams, or by polymerization. The resulting coated substrate has a smooth layer with the plurality of substances homogeneously mixed therein.

BRIEF DESCRIPTION OF THE DRAWINGS

The invention will be described in detail herein with reference to the following figures wherein.

DETAILED DESCRIPTION OF THE PREFERRED EMBODIMENTS

The invention will be described in relation to coating a cylindrical or belt-like substrate, and particularly rigid cylindrical and flexible belt photoreceptor substrates for photocopiers. The invention, however, is applicable to other coated substrates and/or coating processes.

Figure 1A:
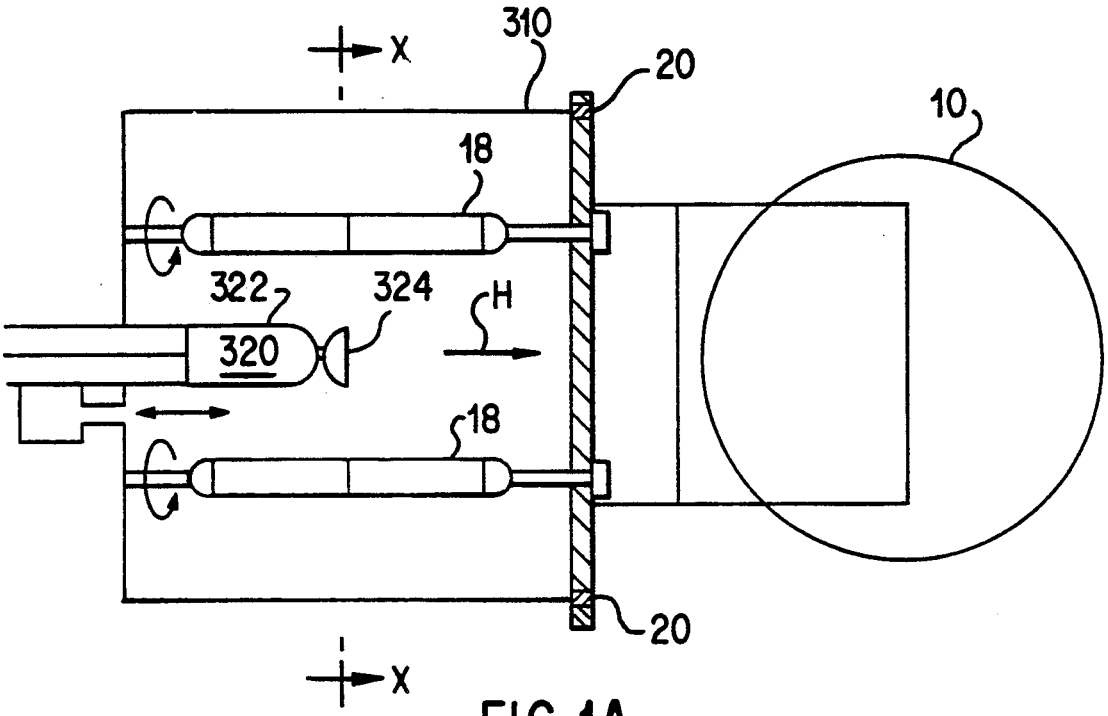
FIG. 1A is a schematic cross-sectional top view of the coating chamber.
Figure 1B:
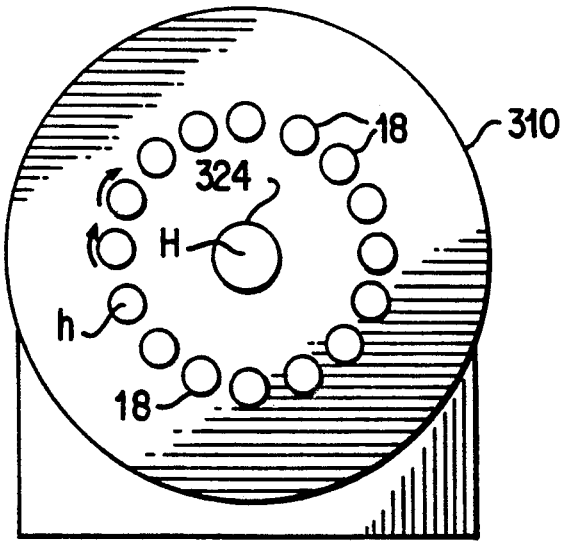
FIG. 1B is a schematic cross-sectional side view of the coating chamber taken along the lines X—X of FIG. 1A.

In a preferred embodiment, the photoreceptors are coated using solutions/dispersions within respective fluid streams which are mixed and atomized substantially at the bell of an electrostatic rotary atomizer 320 (FIGS. 1A and 1B). The electrostatic rotary atomizer 320 includes two parts: an atomizer housing 322 enclosing rotary turbine blades (not shown) and feed conduits (not shown) for the plurality of streams of coating solutions and solvents; and a rotating bell or cap 324 spaced from one end of the atomizer housing 322. In operation, the plurality of streams of coating solutions and solvents are expelled through injection ports at the end of the atomizer housing 322 against the rotating bell or cap 324, which atomizes and mixes the coating solutions and solvents and directs a charged spray radially outward from the rotary atomizer. As the bell or cap rotates, the atomizer 320 can be reciprocated along the axis of the substrate to be coated. Conventional mechanisms are available for rotating and reciprocating the atomizer 320.

Figure 3A:
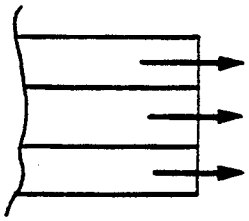
FIGS. 3A-D are cross-sectional views of the outlets of the fluid streams in the rotary atomizer used in the process of the present invention.
Figure 3B:
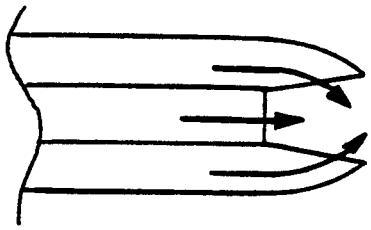
Figure 3C:
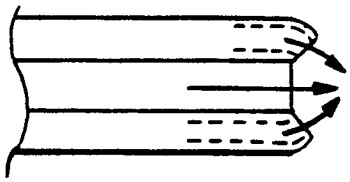
Figure 3D:
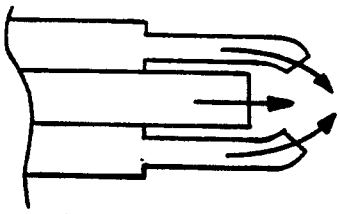

In a preferred embodiment of the invention, a planetary arrangement of horizontal substrates 18 surround the electrostatic rotary atomizer 320 and are thus positioned in a symmetrical configuration with respect to the spray cloud produced by the rotary atomizer 320. More particularly, a planetary array of substrates 18 (FIGS. 3A and 3B) is mounted on a support structure 20 carried by a rotatable carousel 10. Each substrate 18 is rotated about a horizontal axis "h" while horizontally supported about a central horizontal axis H of the support structure 20. The support structure 20 is inserted into a coating chamber 310 having the reciprocating rotary atomizer 320 with its longitudinal axis aligned with the central horizontal axis H of the support structure 20 for applying a coating formulation radially outward into the planetary array of substrates 18. Each substrate thus receives a uniform coating. To enhance the application of the coating, a fast evaporating solvent may first be sprayed into the sealed coating chamber 310 (via a mechanism described below) to obtain a preset vapor pressure of up to saturation of the air within the chamber. Coating solutions containing the same fast evaporating solvent can be then sprayed using the electrostatic rotary atomizer 320 while rotating the substrates and reciprocating the atomizer back and forth along the central axis H in the center of the planetary configuration.

The reciprocating rotary atomizer centrally located in the planetary array of rotating substrates has several advantages. In addition to applying a uniform coating to the substrate, the atomization and curing processes are separated allowing each process to be better defined and controlled. In addition, fast evaporating solvents may be used to reduce the drying requirements by reducing the drying time and the energy required for drying. The atomizer centrally located in the sealed chamber of the planetary array of rotating horizontal substrates also provides for a narrow distribution of small droplets which allows for a uniform thin coating in all substrates without typical coating defects such as "orange peel" effects.

In a preferred embodiment, the coating formulation of the coating solutions and solvents are expelled at about 50–400 cc/minute at an atomizer speed of 15,000–60,000 RPM, a reciprocation speed of 5–40 mm/sec, and an electrostatic voltage 30–150 kilovolts (plus or minus charge). The coating formulation preferably have concentrations of 0.5–50% solid and a viscosity of 1–1000 centipoise. The substrates are rotating at about 20–250 RPM in a coating chamber having a temperature of 0°–30° C. The coating formulations can include coating materials such as nylon, polyester or polycarbonate; and solvents such as methylene chloride, toluene, methanol, or ethanol. All the parameters discussed above may vary depending on the coating solution, solvent and desired type of coating.

In the application of solvent based films on the charge receptor substrates using a rotary atomizer or other atomizer device, considerable solvent evaporation occurs during film coating and leveling. If solvent evaporation is excessive, the quality of the film coating is degraded. To counteract this potential disadvantage, the coating chamber is sealed and provided with a solvent vapor control mechanism to limit and control the rate of solvent evaporation during droplet homogenization and flight, film formation and film solidification. In summary, the solvent vapor control mechanism introduces a controlled amount of solvent vapor into the coating chamber prior to film deposition, maintains the solvent concentration in the chamber gas near saturation during film leveling and limits the rate of solvent vapor removal during the initial stages of solvent evaporation to prevent hydrodynamic instabilities which could cause patterning or pockets (i.e., an orange-peel effect) in the dried film. The solvent vapor control mechanism can supply solvent either directly through the electrostatic rotary atomizer 320 or through a separate inlet device for introducing solvent into the coating chamber 310.

Figure 2A:
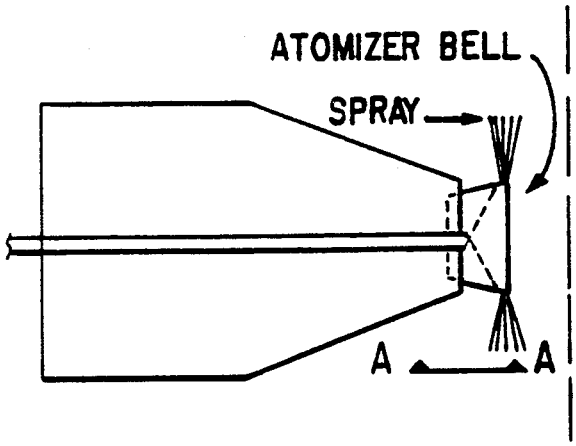
FIG. 2A is a cross-sectional view of a single fluid stream as used in the related art.
Figure 2B:
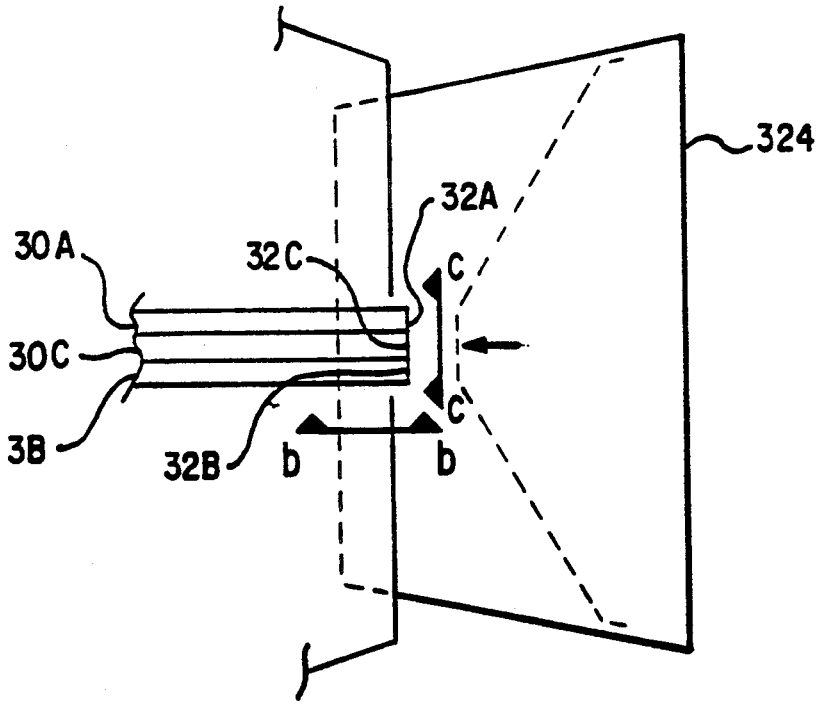
FIG. 2B is an enlarged view of the outlet end of the rotary atomizer in accordance with the claimed invention.

As can be seen in FIG. 2A, the related art delivers a single fluid through a single fluid tube to a single nozzle for spraying the fluid onto the bell of the rotary atomizer. In contrast, as can be seen in FIGS. 2B and 3A to 3D, the present invention utilizes a rotary atomizer which separately delivers a plurality of fluid streams to the bell of the atomizer, and mixes and atomizes the plurality of fluid streams substantially at the bell. As can be seen in FIG. 2B, a distributor or bell 324 is mounted on the shaft 325 and is spaced from the outlet end of the housing 322, for atomizing fluid delivered through the feed tubes 30A, 30B, 30C . . . and directing a spray of the fluids radially outward. The multiple fluid streams are combined at or very near the atomizer bell, and in flowing over the rapidly spinning bell, the fluid streams undergo high Reynolds number flow. Thus, the bell of the rotary atomizer serves to both thoroughly mix and atomize the fluid delivered in the plurality of fluid streams.

A plurality of injection ports 32A, 32B, 32C . . . each communicating with a corresponding feed tube 30A, 30B, 30C . . . , is located at the outlet end of the housing for injecting the fluids toward the bell 324. The number of injection ports and corresponding feed tubes may vary from two to about twenty tubes and ports. Preferably, there are three to seven injection ports which are symmetrically arranged about the central longitudinal axis. FIGS. 3A to 3D show different outlet arrangements of the fluid conduits for delivering the fluid streams to the bell of the rotary atomizer.

In the preferred atomizer (a Nordson RA-12 available from Nordson Corporation of Amherst, Ohio modified in accordance with the structure below), a space of approximately 1 cm in diameter by 20 cm long is available inside the turbine blades for the array of injection ports. If the individual tubes were made small enough, perhaps as many as twenty tubes could be fitted in this space. It has been found that seven tubes is a convenient number due to current process requirements and the symmetry of the array.

The plurality of conduits for delivering the plurality of fluid streams to the bell of the atomizer is an effective arrangement because no cross-contamination occurs in the conduits as can occur by consecutively feeding different substances with a single feed conduit. When the coating fluids share a common delivery tube to the atomizer, difficulties are encountered in the flushing of the tube between successive layer coatings. Precipitate sludges can form in the tube due to solvent/polymer incompatibilities, thus resulting in the deposition of sludge particle defects on the surface of the substrate or in the common fluid line, eventually resulting in blockage of the common fluid line.

The present invention is effective for reducing the process time required for coating the substrate. Advantageously, different coating dispersions/solutions can be simultaneously deposited in a single layer on a substrate, rather than depositing layer upon layer with the time-consuming drying between layers. In addition, the process need not be interrupted for line flushing between layers. Manufacturing process cycle time is reduced, and the unit manufacturing costs are lower. In addition, solvent waste is minimized, since less line flushing is required. Ecological benefits of this are obvious since excess solvents are not released to the atmosphere.

Substrates such as photoreceptors, having novel charge generation layers are also contemplated. It is possible to deposit a single layer composed of more than one substance on a substrate, by delivering a plurality of substances such as charge generating (photoconductive) pigments, to the bell of a rotary atomizer such that the plurality of substances are mixed and atomized and deposited on the substrate in a homogenous smooth layer. In fabricating a photoreceptor with such a layer, the particular properties of each individual substance are combined to render a photoreceptor with superior imaging performance not previously possible.

In a preferred embodiment, a photoreceptor is formed which is sensitive to, and photodischarges from, a broad range of wavelengths. Depending upon the individual substances used to form the single multisubstance layer, such a photoreceptor could be sensitive, for example, to both visible and infrared light, and thus would be usable in both light lens copiers and laser printers (the preferred photoreceptor could be sensitive to an inexpensive infrared laser diode light source for laser printers). Photoconductive pigments sensitive to visible light include, inter alia, dibromoanthanthrone, benzimidizole perylene, trigonal selenium, and various bisazo derivatives. Photoconductive pigments sensitive to infrared light include, inter alia, squaraine derivatives and phthalocyanine derivatives such as metal free phthalocyanine, copper phthalocyanine, vanadyl phthalocyanine, titanyl phthalocyanine, titanyl fluorophthalocyanine, and chloroindium phthalocyanine.

The inventive process enables mixing of multiple pigment dispersions in virtually any proportions. When a blend of dispersions is deposited on a substrate surface in the liquid phase, the deposited mixture of solvents, pigments and binders may not be stable. Undesirable effects such as agglomeration can occur. However, with the present coating process, the dispersions do not have to be premixed. Thus, the lifetime of the mixed liquid phase is very short, since mixing does not occur prior to the delivering step with subsequent delivery to the rotary atomizer in a single fluid tube. Rather, the plurality of fluids are separately delivered to the bell of the atomizer in a plurality of fluid tubes and mixed substantially at the bell of the atomizer. Thus, even if the plurality of fluids are incompatible such that agglomeration could occur after a few minutes in the liquid phase, such undesirable effects are avoided since the coating on the substrate can be dried within time periods as short as one minute or less after the mixing and atomizing step at the bell of the rotary atomizer. Rotary atomization according to the present process, offers the opportunity of complete blending, deposition, and solidification of multi-pigment charge generator layers in times as short as one minute or less.

When highly volatile solvents are employed, evaporation of the atomized coating composition during the coating operation may be prevented by pre-saturating the coating chamber with solvent vapor to prevent evaporation during deposition of the atomized coating composition. Thereafter, accelerated drying is performed by removing the solvent vapor from the chamber after deposition by the introduction of a flowing gas stream. The coatings on the substrate may also be polymerized in situ after deposition by suitable techniques such as thermal or photochemical curing to form the final solid film layer.

Different substances can make up the fluid streams in the present invention, such as blocking substances, adhesive substances, charge generating/photoconductive/photogenerating substances and charge transport substances.

Suitable blocking substances include gelatin (e.g. Gelatin 225, available from Knox Gelatine Inc.), and Carboset 515 (B.F. Goodrich Chemical Co.,) dissolved in water and methanol, polyvinyl alcohol, polyamides, gammaaminopropyl triethoxysilane, and the like. The blocking substance may be mixed in a fluid stream with any suitable liquid carrier. Typical liquid carriers include water, methanol, isopropyl alcohol, ketones, esters, hydrocarbons, and the like.

Suitable adhesive substances include polyesters (e.g. du Pont 49,000, available from E.I. du Pont de Nemours & Co.), 2-vinylpyridene, 4-vinylpryridine and the like. The adhesive substance may be applied with a suitable liquid carrier. Typical liquid carriers include methylene chloride, methanol, isopropyl alcohol, ketones, esters, hydrocarbons and the like.

Suitable photoconductive/photogenerating substances may be delivered in one of the fluid streams. The photoconductive substance may contain inorganic or organic photoconductive materials. Typical inorganic photoconductive materials include well known materials such as amorphous selenium, selenium alloys, halogen-doped selenium alloys such as selenium-tellurium, selenium-tellurium-arsenic, selenium-arsenic, cadmium sulfide, zinc oxide, titanium dioxide and the like. Inorganic photoconductive materials are normally dispersed in a film-forming polymer binder. Typical organic photoconductors include phthalocyanines, quinacridones, pyrazolones, polyvinylcarbazole-2,4,7-trinitro-fluorenone, anthracene and the like. Other organic substances include the previously mentioned visible light and infrared light sensitive pigments. Many organic photoconductor materials may also be used as particles dispersed in a resin binder. Such materials may be employed to produce either positive or negative charging photoreceptors.

The photoconductive/photogenerating material may comprise a single material or multiple materials comprising inorganic or organic compositions and the like. One example of such a material is described in U.S. Pat. No. 3,121,006 (incorporated herein by reference) wherein finely divided particles of a photoconductive inorganic compound are dispersed in an electrically insulating organic resin binder. Useful binder materials disclosed therein include those which are incapable of transporting for any significant distance injected charge carriers generated by the photoconductive particles. Thus, the photoconductive particles must be in substantially contiguous particle-to-particle contact throughout the layer on the substrate for the purpose of permitting charge dissipation required for cyclic operation. Thus, about 50 percent by volume of photoconductive particles is usually necessary in order to obtain sufficient photoconductive particle-to-particle contact for rapid discharge.

Other examples of photoconductive/photogenerating substances include trigonal selenium, various phthalocyanine pigments such as the X-form of metal free phthalocyanine described in U.S. Pat. No. 3,357,989 (incorporated here by reference), metal phthalocyanines such as copper phthalocyanine, quinacridones available from Du Pont under the tradename Monastral Red, Monastral violet and Monastral Red Y, substituted 2,4-diaminotriazines disclosed in U.S. Pat. No. 3,442,781 (incorporated herein by reference), polynuclear aromatic quinones available from Allied Chemical Corporation under the tradename Indofast Double Scarlet, Indofast Violet Lake B, Indofast Brilliant Scarlet Indofast Orange. Examples of photosensitive substances having electrically operative properties include diamine containing materials, dyestuff generator materials and oxadiazole, pyrazolone, imidazole, brompyrene, nitrofluorene and nitronaphthalimide derivative-containing charge transport layer materials disclosed in U.S. Pat. No. 3,895,944 (incorporated herein by reference); generator and hydrazone-containing charge transport materials disclosed in U.S. Pat. No. 4,150,987 (incorporated herein by reference); generator and triaryl pyrazoline compound-containing charge transport substances disclosed in U.S. Pat. No. 3,837,851 (incorporated herein by reference); and the like.

The photoconductive/photogenerating composition or pigment may be present in the film-forming polymer binder compositions in various amounts. For example, from about 10 percent by volume to about 90 percent by volume of the pigment may be dispersed in about 10 percent by volume to about 90 percent by volume of the film-forming polymer binder composition, and preferably from about 20 percent by volume to about 30 percent by volume of the pigment may be dispersed in about 70 percent by volume to about 80 percent by volume of the film-forming polymer binder composition. The particle size of the photoconductive compositions and/or pigments is preferably between about 0.01 micrometer and about 0.5 micrometer to facilitate better coating uniformity.

Any suitable transport material may be applied as one of the coatings of this invention to form a multi-substance photoconductor layer. The transport material may contain a film-forming polymer binder and a charge transport material. Numerous inactive resin materials may be employed in the charge transport material including those described, for example, in U.S. Pat. No. 3,121,006, the entire disclosure of which is incorporated herein be reference. The resinous binder for the charge transport material may be identical to the resinous binder material employed for the charge generating material. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymer, vinylacetate-vinyl-idenechloride copolymers, styrene-alkyd resins, and the like. These polymers may be block, random or alternating copolymers.

If desired, the photoreceptor may also include an overcoating. Any suitable overcoating may be utilized in the fabrication of the photoreceptor of this invention. Typical overcoatings include silicone overcoatings described, for example, in U.S. Pat. No. 4,565,760, polyamide overcoatings (e.g. Elvamide, available from E.I. du Pont de Nemours & Co.), tin oxide particles dispersed in a binder described, for example, in U.S. Pat. No. 4,426,435, metallocene compounds in a binder described, for example, in U.S. Pat. No. 4,315,980, antimony-tin particles in a binder, charge transport molecules in a continuous binder phase with charge injection particles, described in U.S. Pat. No. 4,515,882, polyurethane overcoatings and the like, the disclosures of U.S. Pat. No. 4,565,760, U.S. Pat. No. 4,426,435, U.S. Pat. No. 4,315,980, and the U.S. Pat. No. 4,515,882 being incorporated herein by reference in their entirety. The choice of overcoating materials would depend upon the specific photoreceptor prepared and the protective quality and electrical performance desired. Generally, any overcoatings applied have thicknesses between about 0.5 micrometer and about 10 micrometers.

Although the process in accordance with the present invention (and substrate formed therefrom) has been described in connection with preferred embodiments, it will appreciated by those skilled in the art that additions, modifications, substitutions and deletions not specifically described may be made without departing from the spirit and scope of the invention defined in the appended claims.

What is claimed is:

1. A method of depositing a layer on a substrate, comprising the steps of:

i. separately delivering at least two fluid streams to a bell of a rotary atomizer;

ii. combining said at least two fluid streams substantially at the bell of the rotary atomizer such that the bell atomizes and mixes said at least two fluid streams into a substantially homogenous atomized mixture at the bell; and iii. depositing said substantially homogenous atomized mixture onto the substrate in the form of a layer on said substrate.

2. The method of claim 1, wherein at least one of said at least two fluid streams is a stream comprising a first photoconductive material.

3. The method of claim 2, wherein another of said at least two fluid streams is a stream comprising a material selected from the group consisting of blocking substances, adhesive substances, photoconductive substances and charge transport substances.

4. The method of claim 1, wherein one of said at least two fluid streams comprises a visible light sensitive photoconductive substance and another of said at least two fluid streams comprises an infrared light sensitive photoconductive substance.

5. The method of claim 1, further comprising the steps of:

prior to the step of delivering the at least two fluid streams to a bell of a rotary atomizer, preparing at least two separate liquid dispersions of photoconductive particles; and loading said at least two separate liquid dispersions of photoconductive particles into a coating solution delivery system for delivering said at least two separate liquid dispersions of photoconductive particles as part of said respective at least two fluid streams.

6. The method of claim 1, further comprising the step of:

filling a chamber with a solvent prior to said step of delivering, the chamber having therein said rotary atomizer and substrate; and emptying said solvent from said chamber after said step of depositing, for solidifying said layer on said substrate.

7. The method of claim 6, wherein said steps of combining, depositing and emptying result in a solidified layer within a time period of one minute or less.

8. The method of claim 6, wherein the step of emptying comprises the step of introducing a flow of a gas stream through said chamber to remove the solvent from said chamber.

9. The method of claim 1, wherein said layer on said substrate is solidified by polymerization.

10. The method of claim 1, wherein said bell is rapidly spinning and induces high Reynolds number flow to said at least two fluid streams in a radially outward direction from said bell.

11. The method of claim 1, wherein at least one of said at least two fluid streams comprises a solvent and a photoconductive substance.

12. The method of claim 11, wherein another of said at least two fluid streams comprises a charge transport substance.

13. The method of claim 1, wherein said substrate is a photoreceptor.

14. The method of claim 13, wherein each of said fluid streams comprises a liquid dispersion of different photoconductive particles.

15. The method of claim 1, wherein said layer formed on said substrate is a smooth uniform layer.

16. The method of claim 1, wherein said substrate has an axis and rotates axially during said steps of delivering, combining and depositing.

17. A photoreceptor made by a process comprising the steps of:

i. separately delivering at least two fluid streams to a bell of a rotary atomizer;

ii. combining said at least two fluid streams substantially at the bell of the rotary atomizer such that the bell atomizes and mixes said at least two fluid streams into a substantially homogenous atomized mixture at the bell;

iii. depositing said substantially homogenous atomized mixture onto the substrate in the form of a layer on said substrate.

* * * * *